US006991105B2

(12) United States Patent
Winnard

(10) Patent No.: US 6,991,105 B2
(45) Date of Patent: Jan. 31, 2006

(54) APPARATUS FOR RELEASABLY HOLDING A TOOL

(76) Inventor: Stanley D. Winnard, 2528 Clear Spring North, Irving, TX (US) 75063

( * ) Notice: Subject to any disclaimer, the term of this patent is extended or adjusted under 35 U.S.C. 154(b) by 85 days.

(21) Appl. No.: 10/422,481

(22) Filed: Apr. 24, 2003

(65) Prior Publication Data

US 2004/0211691 A1 Oct. 28, 2004

(51) Int. Cl.
*B65D 85/20* (2006.01)

(52) U.S. Cl. ..... 206/378; 211/70.6

(58) Field of Classification Search ..... 206/372–378, 206/806, 493; 211/70.6
See application file for complete search history.

(56) References Cited

U.S. PATENT DOCUMENTS

| | | | | |
|---|---|---|---|---|
| 3,405,377 | A * | 10/1968 | Pierce | 206/378 |
| 5,228,570 | A * | 7/1993 | Robinson | 206/378 |
| 5,467,874 | A * | 11/1995 | Whitaker | 206/378 |
| 5,501,342 | A * | 3/1996 | Geibel | 206/378 |
| 6,168,018 | B1 * | 1/2001 | Ramsey et al. | 206/378 |
| 6,386,363 | B1 * | 5/2002 | Huang | 206/378 |
| 6,488,151 | B2 * | 12/2002 | Ramsey et al. | 206/378 |
| 6,581,894 | B1 * | 6/2003 | Tong | 206/378 |

* cited by examiner

*Primary Examiner*—Luan K. Bui
(74) *Attorney, Agent, or Firm*—Sanford E. Warren, Jr.; Winstead Sechrest & Minick

(57) ABSTRACT

A tool holder has a carrier and a boss movable within the carrier. The boss is configured to accept the drive end of the tool. A locking pin within the boss releasably engages the boss to the tool when the boss is turned.

8 Claims, 7 Drawing Sheets

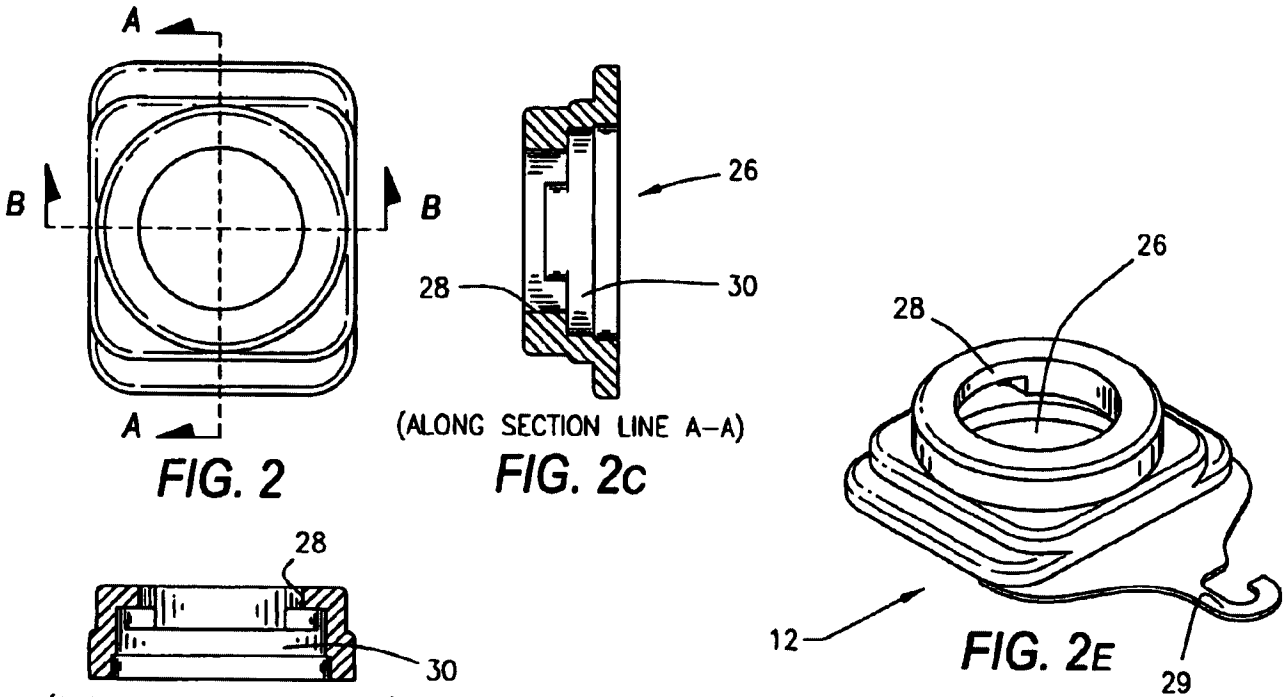
FIG. 2E
FIG. 2C
FIG. 2
FIG. 2A
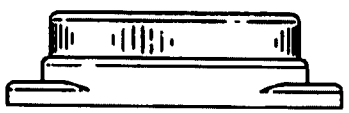
FIG. 2D
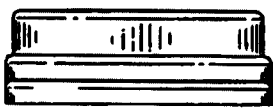
FIG. 2B (ALONG SECTION LINE C–C)

(ALONG SECTION LINE D–D)

APPARATUS FOR RELEASABLY HOLDING A TOOL

TECHNICAL FIELD OF THE INVENTION

The present invention relates to tool holders and more particularly to an apparatus for securely holding a socket tool that may be easily released by a user.

BACKGROUND OF THE INVENTION

Almost every mechanic, maintenance technician and do-it-yourselfer around the world has at least one set of sockets. A socket set is practically indispensable for anyone who needs to tighten or loosen bolts and nuts. Many people, in fact, have multiple sets of sockets. Metric, standard, deep, 6-point, 12-point, ¼" drive, ⅜" drive, ½" drive and impact are just a few of the different types of sockets. Some industries such as the aircraft heavy industrial machinery industries use ¾" drive or even 1" drive sockets. These types of sockets are found in a number of combinations; for example, a person may have an entire set of metric size, 6-point, ⅜" drive, deep sockets in addition to other more common combinations.

Although having many types of sockets is beneficial to have the correct tool for any job, storing and organizing each socket can be a daunting task. Many sockets tend to be small, and are thus easily misplaced around a home or shop. Additionally, sockets are usually cylindrical and therefore can easily roll great distances if dropped on a smooth garage floor. This problem is exasperated given the inadequate storage devices that are supplied with many socket sets.

For example, many sockets are supplied in a molded plastic case that may have wells to cradle each socket. Although easy for a user to locate and remove, this type of storage device has often become a nightmare for many socket owners. The cases are designed to "sandwich" the sockets when closed to prevent socket movement when the case is transported. The supplied cases, however, tend to wear and allow sockets to freely mix within the case. A user must spend valuable time re-sorting the sockets so that a proper socket may be easily located for a particular job. On a more catastrophic level, many users have lifted their molded plastic socket case only to find that the clasps on the case had opened or broken. The result is a disheartening crash of tools that typically scatters every socket into the furthest reaches of the garage or work area. Many sockets have been permanently lost in such an event.

An alternative to holding and organizing sockets in cases is by using a socket holding strip. These strips usually have multiple bent spring steel clips that are captured by a thin steel rail. The sockets are retained on the spring steel clips, which may slide along the rail. These strips tend to hold sockets very well when new. Great holding power, however, is not beneficial when a user attempts to remove a socket with oily or greasy hands. Additionally, the clips tend to lose their holding force after moderate use, which may result in sockets being inadvertently detached from the strip and lost.

Considering the inadequacies of available socket holding devices, a socket holder that does not allow sockets to become disorganized or lost during transport is needed. Additionally, there is a need for a socket holder that does not hinder a user from removing a desired socket.

SUMMARY OF THE INVENTION

Therefore, a need has arisen for an improved apparatus that securely holds sockets yet allows a user to easily obtain a socket from the holder.

In accordance with one embodiment of the present invention, a socket holder has a carrier and a boss movable within the carrier. The boss is configured to accept the drive end of the socket. A locking pin within the boss releasably engages the boss to the socket when the boss is turned.

In another embodiment of the present invention a twist-lock socket holder has a carrier that has a cam surface and a boss housed generally within the carrier. The boss is generally rotatable within a bearing surface of the carrier. The boss also has one or more cam followers. The cam followers generally engage the cam surface to urge the boss generally along an axis tangential to a horizontal plane of the carrier. A locking pin is housed generally within the boss, the locking pin is generally tangential to the horizontal plane of the carrier. A detent ball is housed within a detent in the boss. The detent ball is generally retained by a retaining surface on the locking pin and urged into a socket detent by a locking surface of the locking pin when the socket is placed on the boss and rotated.

BRIEF DESCRIPTION OF THE DRAWINGS

For a more complete understanding of the present invention, and the advantages thereof, reference is now made to the following description which is to be taken in conjunction with the accompanying drawings in which like reference numerals indicate like parts and wherein:

FIG. 2 through 2E depicts a socket holder carrier according to one embodiment of the present invention;

DETAILED DESCRIPTION OF THE INVENTION

While the making and using of various embodiments of the present invention are discussed in detail below, it should be appreciated that the present invention provides many applicable inventive concepts that may be embodied in a wide variety of specific contexts. The specific embodiments discussed herein are merely illustrative of specific ways to make and use the invention and do not delimit the scope of the invention.

Figure 1A:
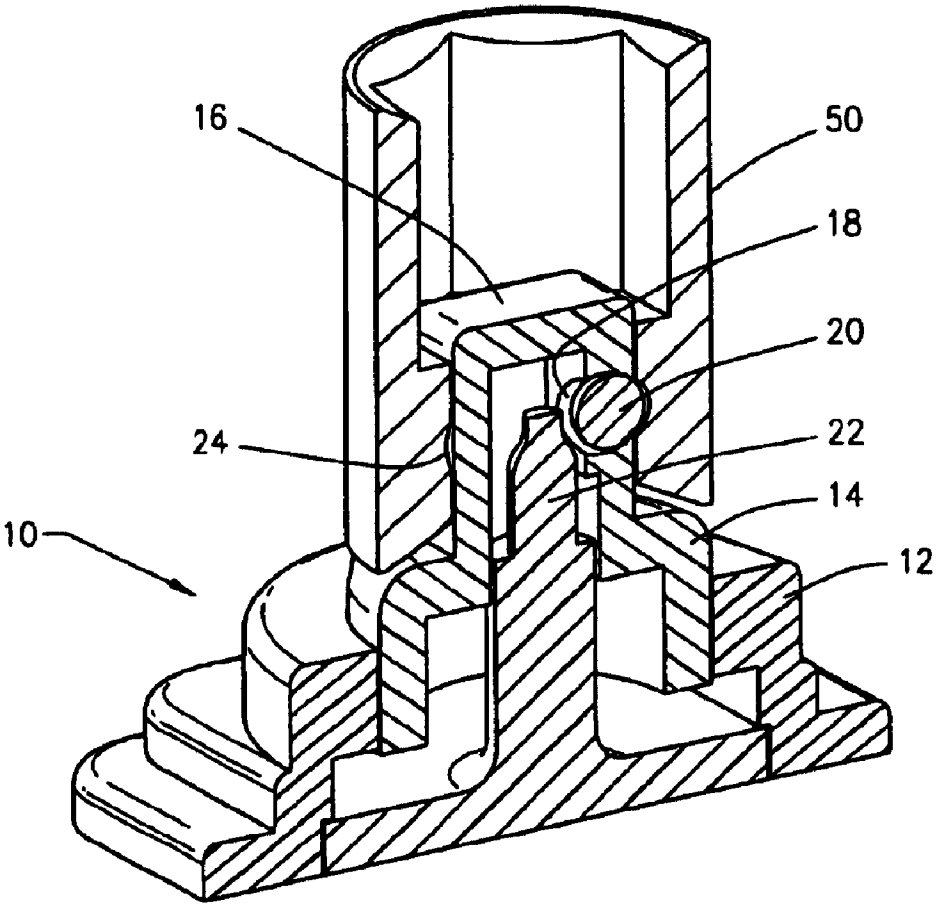
FIG. 1A depicts a sectional view of a socket bolder according to one embodiment of the present invention.
Figure 1B:
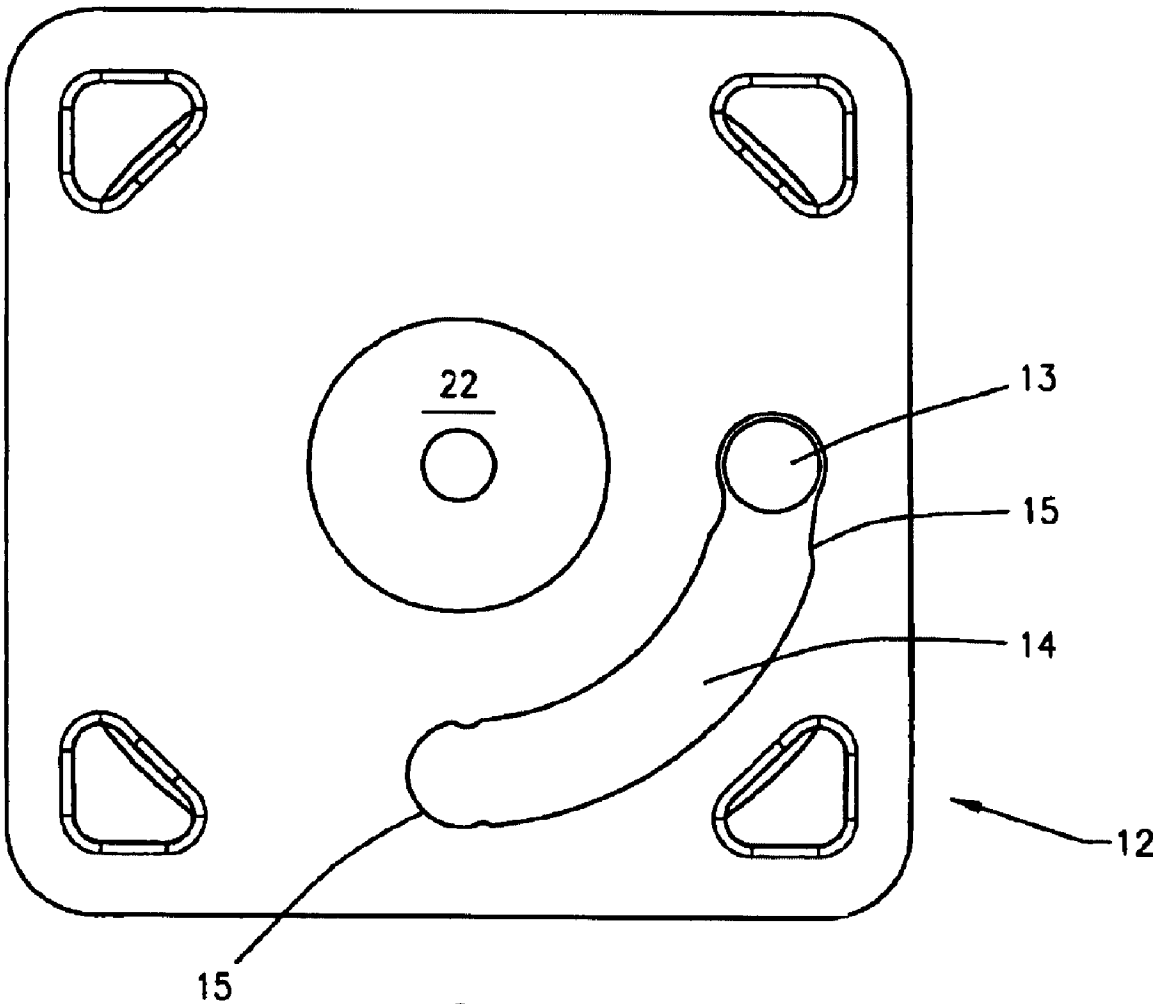
FIG. 1B depicts a view of the lower end of a socket holder incorporating a locking mechanism according to one embodiment of the present invention.

Referring now to FIGS. 1A and 1B, a socket holder 10 according to the present invention is depicted. The socket holder 10 has a carrier 12 that houses a boss 14. The boss 14 has a drive end 16 that fits within a drive of a socket 50. The drive end 16 may be sized to accept a wide range of sockets sizes from ¼" drive to 1" drive, for example. The drive end 16 may also be configured to accept a 6-point box-end wrench, for example. Other configurations of the drive end 16 to hold other tools will be apparent to those of ordinary skill in tool design. The drive end 16 has a detent 18 that houses a detent ball 20. The detent ball 20 may move freely within the detent but may be captured and locked into place by a locking pin 22 that is housed within a central portion of the boss 14 and drive end 16. The locking pin 22, which will be described in greater detail below, serves to urge the detent ball 20 into a socket detent 24. As a user turns the socket 50 clockwise, for example, the boss 14 moves down along the axis of the locking pin 22. Because the end of the locking pin 22 has a contoured profile, the wider profile of the locking pin 22 moves the detent ball 20 into place.

When the detent ball 20 is in the socket detent 24, the socket 50 is securely attached to the socket holder 10. The detent ball 20 may be magnetized to help urge the detent ball 20 into the socket detent 24 when a ferrous socket 50 is placed on the drive end 16. The locking pin 22 may also have a locking detent (not shown) that releasably secures the detent ball 20 when the socket 50 is secured by the socket holder 10. The locking detent provides an extra measure of security that prevents the socket 50 from being inadvertently detached from the socket holder 10.

The boss 14 may also have a locking tab 13 that may be molded into the boss 14. The locking tab may snap into a recess 15 on the carrier 12 or the locking pin 22 when the socket holder 10 has secured the socket 50. The action of turning the socket 50 locks and unlocks the locking tab 13 from the recess 15 and serves to give the user tactile feedback that indicates that the socket 50 is secured or released from the socket holder 10. The locking tab 13 also prevents the socket 50 from being inadvertently detached from the socket holder 10. Other mechanisms for preventing the socket holder 10 from inadvertently releasing the socket 50 will be apparent to those having ordinary skill in the art of mechanics.

Turning now to FIGS. 2 through 2E and 3 through 3E, one embodiment of the carrier 12 of the socket holder 10 is depicted in greater detail. The carrier 12 has a generally cylindrical boss opening 26 that accepts the boss 14. A bearing surface 28 engages the outer surface of the boss 14 to allow rotation and axial movement of the boss 14 to allow rotation and axial movement of the boss 14 within the carrier 12. Depending on the application, the clearance between the boss 14 and the bearing surface 28 may be varied. For example, a loose fit clearance is generally preferred for ease of operation of the socket holder 10 and manufacturing cost savings but a close fit clearance may be used to enhance the perception of quality or to prevent debris from collecting between the boss 14 and the carrier 12.

The carrier 12 may be, for example, injection molded plastic; machined, stamped or cast metal or alloys; carbon fiber; and the like. The carrier 12 may have a non-transferable magnet or magnetic material attached to a portion of the carrier 12 so the socket holder 10 may be easily and conveniently attached to a surface such as a tool box or other surface of a work piece such as a car body or an airplane wing. Alternatively, double sided adhesive tape may be attached to a surface of the carrier 12 to facilitate more permanent mounting to workshop surfaces, tool boxes and the like. Several socket holders 10 may also be attached to a single rail or within a strip of channel section. Attaching multiple socket holders 10 allows the user to organize an entire set of sockets in a single location.

Additionally, a hanging tab 29 may be incorporated into the carrier 12. The hanging tab 29 may be designed to hang the socket holder 10 directly to a hook or rod in a store display. As a result, the socket holder 10 may be marketed holding a socket 50 and may be immediately displayed in a store after it arrives from a distributor without any additional packaging. After a user purchases the socket holder 10, the hanging tab 29 may be snapped, broken or removed from the carrier 12 and the socket holder 10 can be placed on a rail or strip of channel section for storage.

The carrier 12 may also be manufactured to aid the user in identifying a particular socket 50. The carrier 12 may also be color-coded to differentiate between standard and metric sizes or drive end sizes, for example. Additionally, the carrier may be marked to indicate the particular size of the socket 50, such as 9/16" or 10 mm, for example. Other forms of socket identification may be incorporated into the boss 14. For example, a post (not illustrated) may be molded or otherwise attached to the top surface of the drive end 16. This post may extend through the socket 50 and be visible above the socket 50 when the socket 50 is releasably attached to the socket holder 10. The post may be color-coded or it may be marked according to the size or configuration of the socket 50. The post may also have an indicator that shows the user whether the socket 50 is locked into place or which direction to turn the socket 50 to the locked or unlocked positions.

Figure 3:
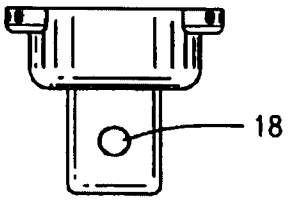
FIG. 3 through 3E depicts a socket holder boss according to one embodiment of the present invention.
Figure 3A:
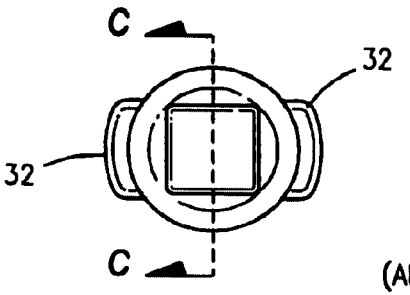
Figure 3C:
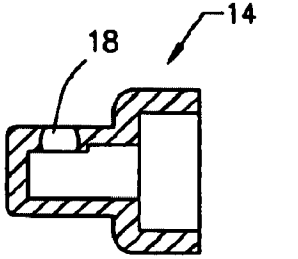
Figure 3B:
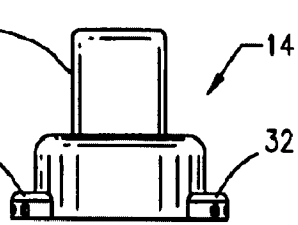
Figure 3D:
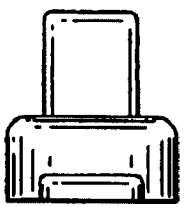
Figure 3E:
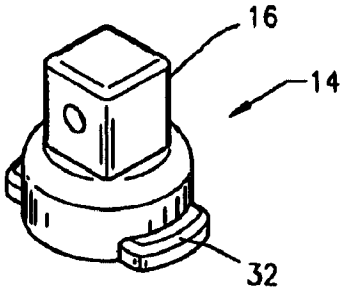

The carrier 12 has a cam surface 30 that serves to move the boss 14 along the axis of the locking pin 22 when the user rotates the boss 14 by twisting the socket 50. As depicted in FIG. 3, one or more cam followers 32 on the boss 14 follow the contours of the cam surface 30 when the boss 14 is rotated. In one embodiment, for example, the cam surface 30 and the cam follower 32 may be one or more screw threads having a large pitch. Other configurations for effecting axial movement of the boss 14 with respect to the locking pin 22 will be apparent to those having ordinary skill in the art of mechanics.

Figure 4A:
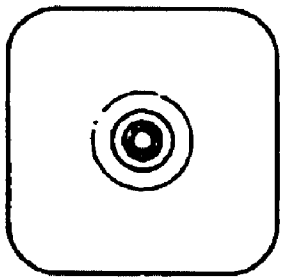
FIGS. 4A–4C depict a socket holder locking pin according to one embodiment of the present invention.
Figure 4B:
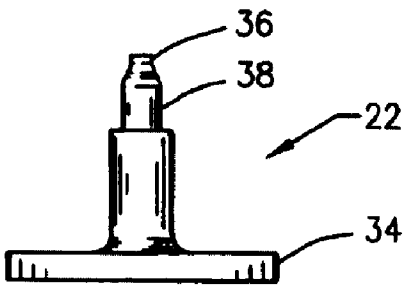
Figure 4C:
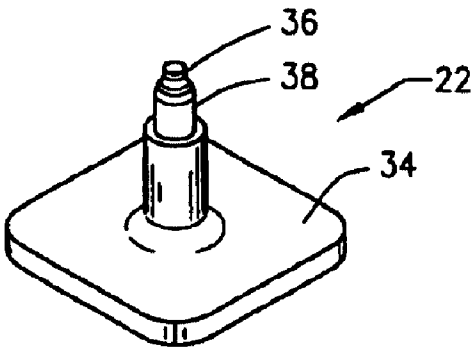

Referring now to FIG. 4, the locking pin 22 according to one embodiment of the present invention is depicted. The locking pin 22 has a base 34. In this particular embodiment, the locking pin 22 is a separate component of the socket holder 10. In other embodiments, however, the locking pin 22 and base 34 may be incorporated into the carrier 12 as a single piece. This single piece, for example, may be molded plastic, machined metal or the like to reduce required pieces to assemble the socket holder 10 and thereby increase manufacturing efficiency.

In this embodiment, the locking pin 22 has a retaining surface 36 and a locking surface 38. The retaining surface 36 serves to hold the detent ball 20 (not shown) within the detent 18 (not shown) when the boss 14 (not shown) is extended along the axis of the locking pin 22. When the boss 14 (not shown) is rotated and retracted along the axis of the locking pin 22, the boss 14 (not shown) moves down onto the locking pin 22. The locking surface 38 consequently urges the detent ball 20 (not shown) further into the detent 18 (not shown) and a portion of the detent ball 20 (not shown) extends into the socket detent 24 (not shown). The socket 50 (not shown), therefore, is securely held by the socket holder 10 (not shown).

The locking surface 38 may have a locking detent (not illustrated) that securely captures the detent ball 20 (not shown) when the boss 14 (not shown) is in the locked position. The locking detent serves as an additional measure of security to prevent the socket holder 10 (not shown) from inadvertently releasing the socket 50 (not shown). To secure and release the socket 50 (not shown) from the socket holder 10 (not shown), the user must overcome slightly more resistance to move the detent ball 20 (not shown) from the locking detent. Other mechanisms for preventing the socket 50 (not shown) from inadvertently releasing from the drive end 16 (not shown) will be apparent to those having ordinary skill in the art of mechanics.

Figures 5A, 5B, 5C, 5D, 5E:
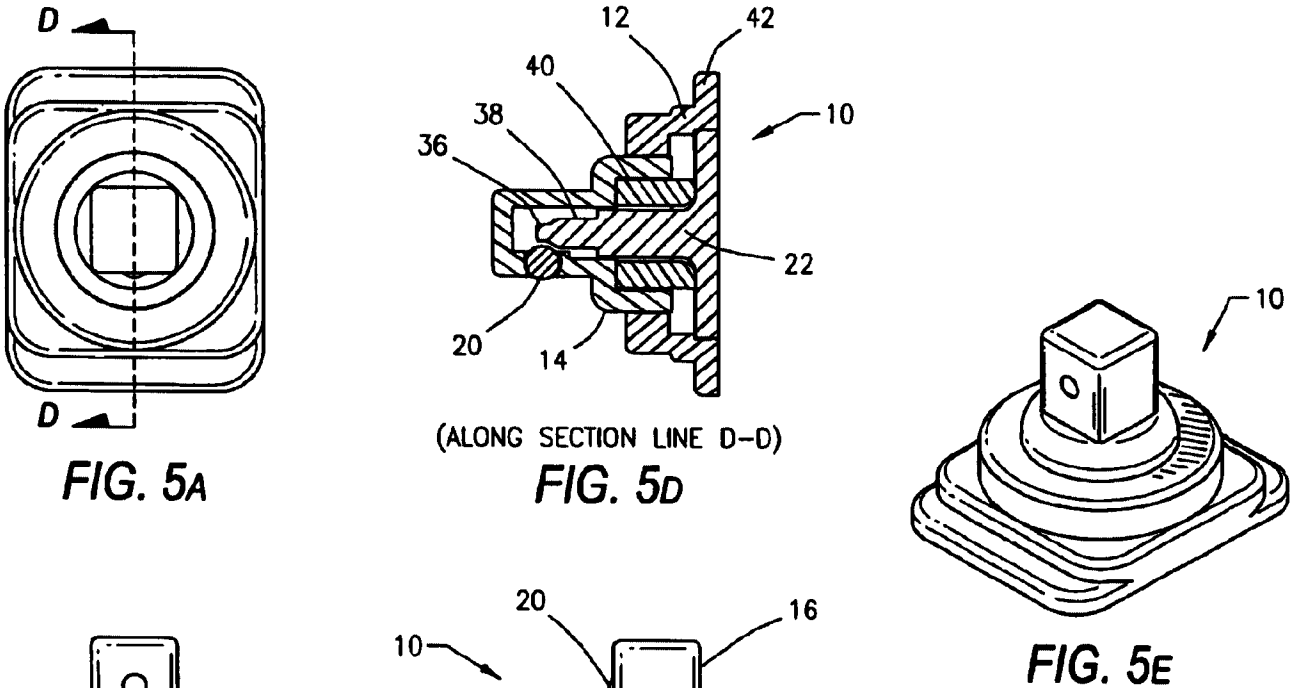
FIGS. 5A–5E depict a socket holder according to one embodiment of the present invention.

Turning now to FIG. 5, an assembled socket holder 10 according to one embodiment of the present invention is depicted. As described above, the locking pin 22 fits generally within the carrier 12 and the boss 14. A shoulder 40 may be incorporated into an assembly that includes the carrier 12 and the locking pin 22. The shoulder may include a snap ring (not illustrated) that engages a mating surface within the boss 14. The shoulder 40 may also include the cam surface 30 (not shown) that engages the corresponding cam follower 32 (not shown) within the boss 14. The cam surface 30 (not shown) and the cam follower 32 (not shown) may be embodied as threads that have a large pitch.

Using the snap ring on the shoulder 40 simplifies the manufacturing process of assembling the socket holder 10. Manufacturers can easily assemble the socket holder 10 by inserting and locating the detent ball 20 within the detent 18 and snapping the boss 14 into place on the carrier 12. The detent ball 20 may be located in the detent 18 using a magnet, for example. Other methods of assembling the socket holder 10 will be apparent to those having ordinary skill in the art of manufacturing.

Figure 6:
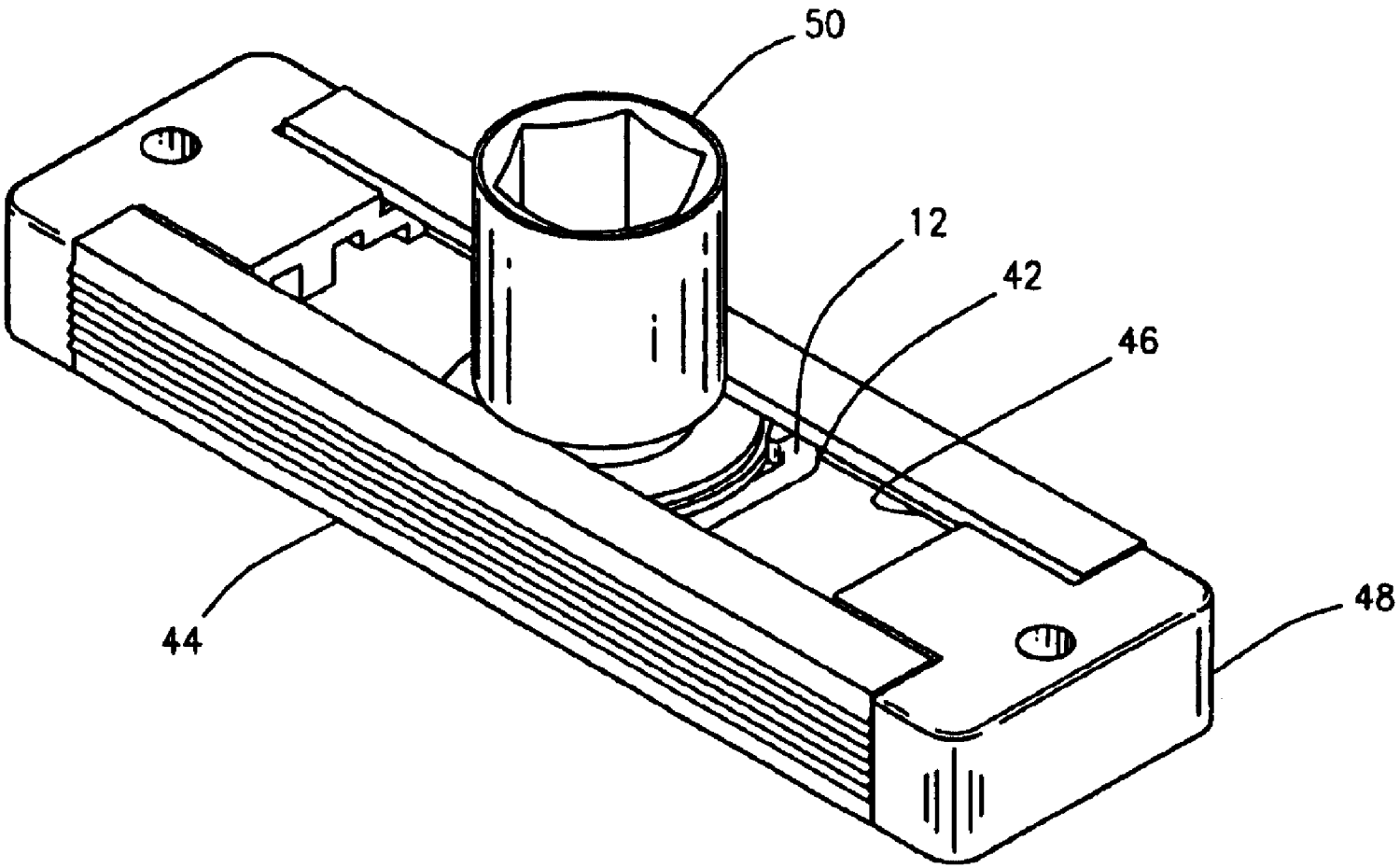
FIG. 6 depicts a socket holder in a storage rail according to one embodiment of the present invention.

A rail 44 for holding one or more socket holders 10 is depicted in FIG. 6. In this particular embodiment, the rail 44 has one or more channels 46 that are configured to accept one or more tabs 42 on the carrier 12 of the socket holder 10. Multiple socket holders 10 may be added to the rail 44 by removing an end cap 48 and sliding the socket holders 10 into the channel 46. The channel 46 may be configured to overlap a top surface of the boss 14 to redundantly secure the boss 14 within the carrier 12. This redundant measure of security is important to industries concerned with management and prevention of foreign objects and debris (FOD).

The rail 44 may be supplied in various lengths to accept large or small socket sets. The rail 44 may also be color coded according to socket type or have labels to identify the location of different sockets within the rail 44. The rail 44 may be manufactured from plastic, metal, carbon fiber and the like. The rail 44 may also have a non-transferable magnet or double-sided tape to attach the rail 44 to a work surface or tool box. The user may consequently assemble a set of sockets 50 that are customized for a particular job on the rail 44 and secure the rail 44 to the particular work piece.

Although the invention has been described in detail herein with reference to the illustrative embodiments, it is to be understood that this description is by way of example only and is not to be construed in a limiting sense. It is to be further understood that numerous changes in the details of the embodiments of the invention and additional embodiments of the invention will be apparent to and may be made by persons of ordinary skill in the art with reference to this description. It is contemplated that all such changes and additional embodiments are within the spirit and scope of the invention as claimed below.

What is claimed is:

1. A tool holder comprising:

a carrier;

a boss movable within the carrier, the boss configured to accept the tool and having a locking tab which may be inserted into a recess on the carrier; and a locking pin within the boss providing for the releasable engagement of the tool when the tool is placed on the boss and the tool is rotated;

wherein the boss releasably engages the tool when the tool is rotated between about 10 degrees and about 90 degrees; and wherein the boss has one or more cam followers that engage a cam surface on the carrier, the cam followers following the cam surface and causing the boss to move axially with respect to a central axis of the boss when the boss is rotated within the carrier.

2. The tool holder of claim 1, wherein the boss has a detent ball within a detent to releasably engage the tool.

3. The tool holder of claim 2, wherein a retaining surface on the locking pin retains the detent ball generally within the detent when the detent ball is disengaged from the tool.

4. The tool holder of claim 1, wherein the boss is configured to accept a ⅜" drive socket.

5. The tool holder of claim 1, wherein the boss is configured to accept a 1" drive socket.

6. The tool holder of claim 1, wherein the boss is configured to accept a ½" drive socket.

7. The tool holder of claim 1, wherein the boss is configured to accept a ¼" drive socket.

8. The tool holder of claim 1, wherein the locking pin is integral with the carrier.

* * * * *